US011408115B2

(12) United States Patent
Tartuferi et al.

(10) Patent No.: US 11,408,115 B2
(45) Date of Patent: Aug. 9, 2022

(54) LAUNDRY WASHING MACHINE EQUIPPED WITH A LIQUID SUPPLY LINE

(71) Applicant: Electrolux Appliances Aktiebolag, Stockholm (SE)

(72) Inventors: Mariano Tartuferi, Porcia PN (IT); Maurizio Del Pos, Pordenone (IT); Andrea Contarini, Sacile (IT); Marco Russo, Porcia (IT)

(73) Assignee: Electrolux Appliances Aktiebolag

( * ) Notice: Subject to any disclaimer, the term of this patent is extended or adjusted under 35 U.S.C. 154(b) by 44 days.

(21) Appl. No.: 16/971,505

(22) PCT Filed: Feb. 22, 2018

(86) PCT No.: PCT/EP2018/054395
§ 371 (c)(1),
(2) Date: Aug. 20, 2020

(87) PCT Pub. No.: WO2019/161898
PCT Pub. Date: Aug. 29, 2019

(65) Prior Publication Data

US 2020/0399817 A1 Dec. 24, 2020

(51) Int. Cl.

| | |
|---|---|
| ***D06F 39/08*** | (2006.01) |
| ***D06F 23/02*** | (2006.01) |
| ***D06F 37/26*** | (2006.01) |
| ***D06F 103/14*** | (2020.01) |
| ***D06F 105/06*** | (2020.01) |

(52) U.S. Cl.
CPC ..... *D06F 39/083* (2013.01); *D06F 23/02* (2013.01); *D06F 37/266* (2013.01); *D06F 39/088* (2013.01); *D06F 39/087* (2013.01); *D06F 2103/14* (2020.02); *D06F 2105/06* (2020.02)

(58) Field of Classification Search
CPC ..... D06F 23/02; D06F 37/266; D06F 39/083; D06F 39/088; D06F 2103/14; D06F 2105/06
See application file for complete search history.

(56) References Cited

U.S. PATENT DOCUMENTS

| | | | |
|---|---|---|---|
| 6,189,170 | B1 | 2/2001 | Sherwood |
| 7,398,661 | B2 | 7/2008 | Rizzetto |
| 7,406,842 | B2 | 8/2008 | Oh et al. |

(Continued)

FOREIGN PATENT DOCUMENTS

| | | | |
|---|---|---|---|
| DE | 4330079 | A1 | 3/1995 |
| EP | 1505191 | A1 | 2/2005 |

(Continued)

OTHER PUBLICATIONS

US 8,794,039 B2, 08/2014, Kim et al. (withdrawn)

(Continued)

*Primary Examiner* — Joseph L. Perrin
(74) *Attorney, Agent, or Firm* — RatnerPrestia

(57) ABSTRACT

A laundry washing machine comprising a cabinet supporting a washing tub external to a washing drum adapted to receive laundry and a liquid supply line for supplying liquid into the washing tub/drum through a nozzle having a tubular portion and a sprayer portion comprising a bent zone. The nozzle comprises an obstruction arranged upstream of the bent zone.

19 Claims, 12 Drawing Sheets

(56) References Cited

U.S. PATENT DOCUMENTS

| | | | | |
|---|---|---|---|---|
| 7,516,630 | B2 | 4/2009 | Kim et al. | |
| 7,802,453 | B2 | 9/2010 | Oh et al. | |
| 8,464,560 | B2 | 6/2013 | Kim et al. | |
| 8,776,297 | B2 | 7/2014 | Im et al. | |
| 8,919,154 | B2 | 12/2014 | Kim et al. | |
| 8,973,628 | B2 | 3/2015 | Kimmel | |
| 8,997,290 | B2 | 4/2015 | Kim et al. | |
| 9,027,256 | B2 | 5/2015 | Kim et al. | |
| 9,121,125 | B2 | 9/2015 | Kim et al. | |
| 9,222,210 | B2 | 12/2015 | Lee et al. | |
| 9,249,534 | B2 | 2/2016 | Im et al. | |
| 9,394,644 | B2 | 7/2016 | Im et al. | |
| 9,567,703 | B2 | 2/2017 | Wright et al. | |
| 9,650,735 | B2 | 5/2017 | Doh et al. | |
| 9,797,080 | B2 | 10/2017 | Doh et al. | |
| 9,845,563 | B2 | 12/2017 | Plata Amarillas et al. | |
| 2005/0028564 | A1* | 2/2005 | Lee | B05B 1/267 68/24 |
| 2009/0120140 | A1* | 5/2009 | Choi | D06F 58/203 68/5 C |
| 2009/0249838 | A1 | 10/2009 | Kim et al. | |
| 2010/0281927 | A1 | 11/2010 | Lee et al. | |
| 2011/0099727 | A1 | 5/2011 | Kim et al. | |
| 2011/0100070 | A1* | 5/2011 | Kim | D06F 39/088 68/200 |
| 2013/0145562 | A1* | 6/2013 | Lee | D06F 39/088 8/137 |
| 2014/0033449 | A1* | 2/2014 | Im | D06F 37/266 8/137 |
| 2014/0109323 | A1* | 4/2014 | Kim | D06F 39/086 8/137 |
| 2014/0109620 | A1 | 4/2014 | Yoon | |
| 2014/0299164 | A1* | 10/2014 | Zhang | D06F 35/008 134/34 |
| 2014/0352363 | A1* | 12/2014 | Kim | D06F 39/088 68/140 |
| 2015/0121969 | A1* | 5/2015 | Lim | D06F 23/04 68/131 |
| 2015/0128657 | A1* | 5/2015 | Kim | D06F 39/088 68/132 |
| 2016/0115635 | A1 | 4/2016 | Lee et al. | |
| 2017/0096767 | A1 | 4/2017 | Kim et al. | |
| 2017/0159223 | A1 | 6/2017 | Alexander et al. | |
| 2019/0203400 | A1* | 7/2019 | Jung | D06F 33/00 |
| 2019/0203405 | A1* | 7/2019 | Lee | D06F 39/088 |

FOREIGN PATENT DOCUMENTS

| | | | |
|---|---|---|---|
| EP | 1507030 | A1 | 2/2005 |
| EP | 2108731 | A2 | 10/2009 |
| EP | 2602381 | A2 | 6/2013 |
| EP | 2754743 | A1 | 7/2014 |
| JP | 2010036016 | A | 2/2010 |
| JP | 2010046125 | A | 3/2010 |
| KR | 20110025566 | A | 3/2011 |
| WO | 2011046363 | A2 | 4/2011 |
| WO | 2011053091 | A2 | 5/2011 |
| WO | 2014131452 | A1 | 9/2014 |

OTHER PUBLICATIONS

US 8,959,689 B2, 02/2015, Kim et al. (withdrawn)

International Search Report and Written Opinion for International Application No. PCT/EP2018/054395, dated Oct. 18, 2018, 8 pages.

* cited by examiner

LAUNDRY WASHING MACHINE EQUIPPED WITH A LIQUID SUPPLY LINE

This application is a U.S. National Phase application of PCT International Application No. PCT/EP2018/054395, filed Feb. 22, 2018, which is incorporated by reference herein.

The present invention concerns the field of laundry washing techniques.

In particular, the invention relates to a liquid/water supply system in laundry washing machines that is capable of efficiently supplying liquid/water to laundry received therein.

BACKGROUND ART

Nowadays the use of laundry washing machines, both "simple" laundry washing machines (i.e. laundry washing machines which can only wash and rinse laundry) and laundry washing-drying machines (i.e. laundry washing machines which can also dry laundry), is widespread.

In the present description, therefore, the term "laundry washing machine" will refer to both a simple laundry washing machine and a laundry washing-drying machine.

Laundry washing machines generally comprise an external casing, or cabinet, provided with a washing tub which contains a rotatable perforated washing drum where the laundry is placed. A loading/unloading door ensures access to the washing drum.

Laundry washing machines typically comprise a water supply unit and a treating agents dispenser, preferably having a drawer with compartments, for the introduction of water and washing/rinsing products (i.e. detergent, softener, rinse conditioner, etc.) into the washing tub. A pipe preferably connects the dispenser to the washing tub.

In known preferred embodiments, the water which reaches the washing tub can selectively contain one of the products contained in the compartments of the dispenser, or such water can be clean and in such a case it may preferably reach the washing tub bypassing the compartments of the dispenser.

In alternative known embodiments, a further separate water supply pipe bypassing the dispenser can be provided, which supplies directly clean water into the washing tub.

Known laundry washing machines are also typically provided with recirculation circuits that drain liquid from the bottom region of the washing tub and re-admit it into another region of the washing tub. Preferably, liquid is re-admitted at an upper region of the washing tub and the recirculation circuit is typically provided with a terminal nozzle opportunely arranged so that the recirculated liquid is sprayed over the laundry.

The recirculation circuit is typically provided with a recirculation pump which is opportunely activated to recirculate liquid when necessary during the washing cycle enhancing distribution of the liquid over the laundry through the nozzle.

Numerous efforts and attempts have been made by laundry washing machine manufacturers to find solutions that optimise the distribution of water over the laundry and different shapes for the terminal nozzle have been proposed.

US2014109620A1 discloses a nozzle, or water supply device, having an upper vertical hollow pipe connectable to a water supplying line and a lower horizontal sprayer. Horizontal sprayer has a trapezoidal shape and wash water is sprayed through the frontal opening of the sprayer, having a slit shape, over the laundry.

However, the nozzles of the known art pose some drawbacks.

A drawback of nozzles of the known art is the decreasing of the spraying efficiency when the flow rate of the water through the supplying line varies.

The nozzles and their shapes are typically designed to work properly at a predetermined, or substantially predetermined, flow rate according to the working pump speed. In particular, the water follows a desired path from the sprayer opening to the laundry in order to be uniformly distributed over the laundry.

If the pump speed varies, nevertheless, the uniform distribution is not guaranteed. In particular, if the pump speed increases turbulences are generated at the sprayer opening thus variating the desired optimal water path.

The object of the present invention is therefore to overcome the drawbacks posed by the known techniques.

An object of the present invention is therefore to propose a liquid supply system which guarantees the desired liquid distribution over the laundry at different flow rate conditions.

Another object of the present invention is to propose a liquid supply system enabling the control of the flow direction of the liquid over the laundry as a function of the flow rate assuring the optimal liquid distribution over the laundry in each working condition.

DISCLOSURE OF INVENTION

Applicant has found that by providing a laundry washing machine comprising a washing tub external to a washing drum and a liquid supply line for supplying liquid into said washing tub/drum through a nozzle having an outlet extremity and by providing said nozzle with an obstruction, it is possible to reach the mentioned objects.

In a first aspect thereof the present invention relates, therefore, to a laundry washing machine comprising:

- a cabinet supporting a washing tub external to a washing drum adapted to receive laundry;
- a liquid supply line for supplying liquid into said washing tub/drum through an outlet extremity, said liquid supply line being provided at an end thereof with a nozzle comprising said outlet extremity, said nozzle comprising a tubular portion extending along an axis and a sprayer portion comprising said outlet extremity and hydraulically communicating with said tubular portion, wherein said sprayer portion comprises a bent zone which is apt to change the direction of a liquid flowing through said tubular portion towards said outlet extremity, wherein said nozzle comprises an obstruction arranged upstream of said bent zone so that the cross-sectional area of said nozzle first decreases and then increases while proceeding from said tubular portion towards said outlet extremity.

Preferably, the cross-sectional area is the area of the nozzle, where the liquid may flow, in a plane perpendicular to said axis.

According to a preferred embodiment of the invention, the cross-sectional area first monotonically decreases and/or then monotonically increases while proceeding from the tubular portion towards the outlet extremity.

In a preferred embodiment of the invention, the cross-sectional area comprises a smaller area wherein the smaller area is defined at a single point along the axis.

Preferably, the tubular portion comprises a portion that extends rectilinearly along the axis.

According to a preferred embodiment of the invention, the nozzle is arranged so that the axis of the tubular portion and a vertical axis, with the laundry washing machine installed on a horizontal floor, form an angle lower than 30° therebetween, preferably form an angle lower than 10° therebetween, more preferably form an angle equal to 7° therebetween.

In a preferred embodiment of the invention, the bent zone is apt to change a first direction of a liquid flowing in the tubular portion into a second direction of the liquid towards the outlet extremity.

According to a preferred embodiment of the invention, the first and second directions are inclined one to the other with an angle comprised therebetween less than 135°, preferably an angle comprised therebetween equal to 90°.

Preferably, the sprayer portion has a width that expands towards the outlet extremity, more preferably has a trapezoidal shape.

According to a preferred embodiment of the invention, the outlet extremity comprises a lower edge and an upper edge connected therebetween at opposite ends.

In a preferred embodiment of the invention, the distance between the upper edge and the lower edge decreases by proceeding from the center of the outlet extremity towards the opposite ends, the distance being measured in a direction parallel to the axis.

Preferably, the lower edge is rectilinear and/or the upper edge is arcuate.

According to a preferred embodiment of the invention, the liquid supply line comprises a recirculation system for draining liquid from the bottom of the washing tub and to re-admit such liquid into a first region of the washing tub/drum, the recirculation system comprising a recirculation pump and a recirculation duct connected to the nozzle.

In a preferred embodiment of the invention, the recirculation pump is a variable-speed pump.

Preferably, the recirculation pump comprises an inlet connected to the bottom of the washing tub and an outlet connected to the recirculation duct.

According to a preferred embodiment of the invention, the liquid supply line is configured to supply liquid into the washing tub/drum at different flow rates.

In a preferred embodiment of the invention, the nozzle is arranged at a bellows interposed between the cabinet and the washing tub.

Preferably, the bellows comprises a housing apt to receive the nozzle.

BRIEF DESCRIPTION OF THE DRAWINGS

Further characteristics and advantages of the present invention will be highlighted in greater detail in the following detailed description of some of its preferred embodiments, provided with reference to the enclosed drawings. In the drawings, corresponding characteristics and/or components are identified by the same reference numbers. In particular.

DETAILED DESCRIPTION OF PREFERRED EMBODIMENTS OF THE INVENTION

The present invention has proved to be particularly advantageous when applied to laundry washing machines, as described below. It should in any case be underlined that the present invention is not limited to laundry washing machines. On the contrary, the present invention can be conveniently applied to laundry washing-drying machines (i.e. laundry washing machines which can also dry laundry).

Figure 1:
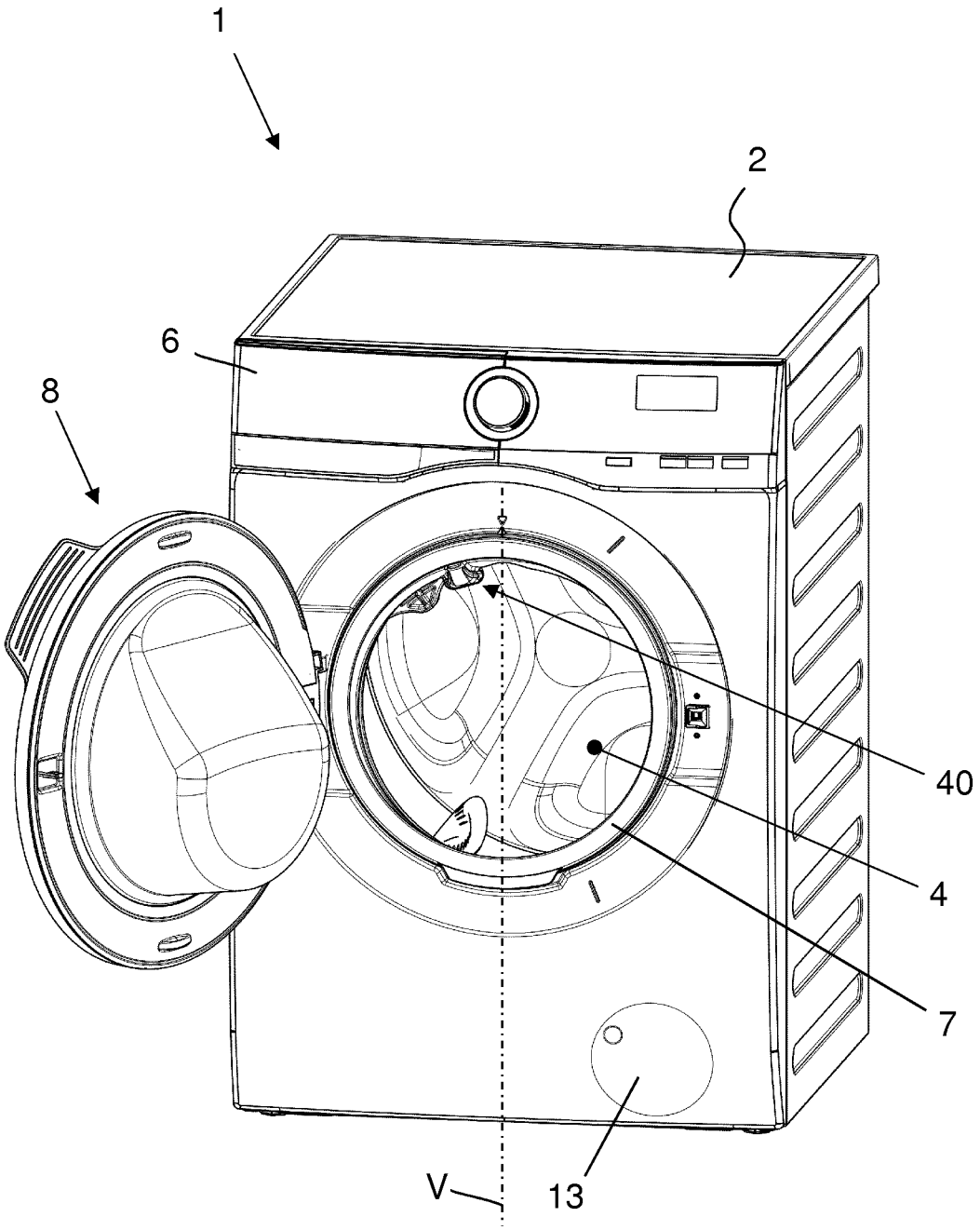
FIG. 1 shows a perspective view of a laundry washing machine according to a preferred embodiment of the invention.
Figure 2:
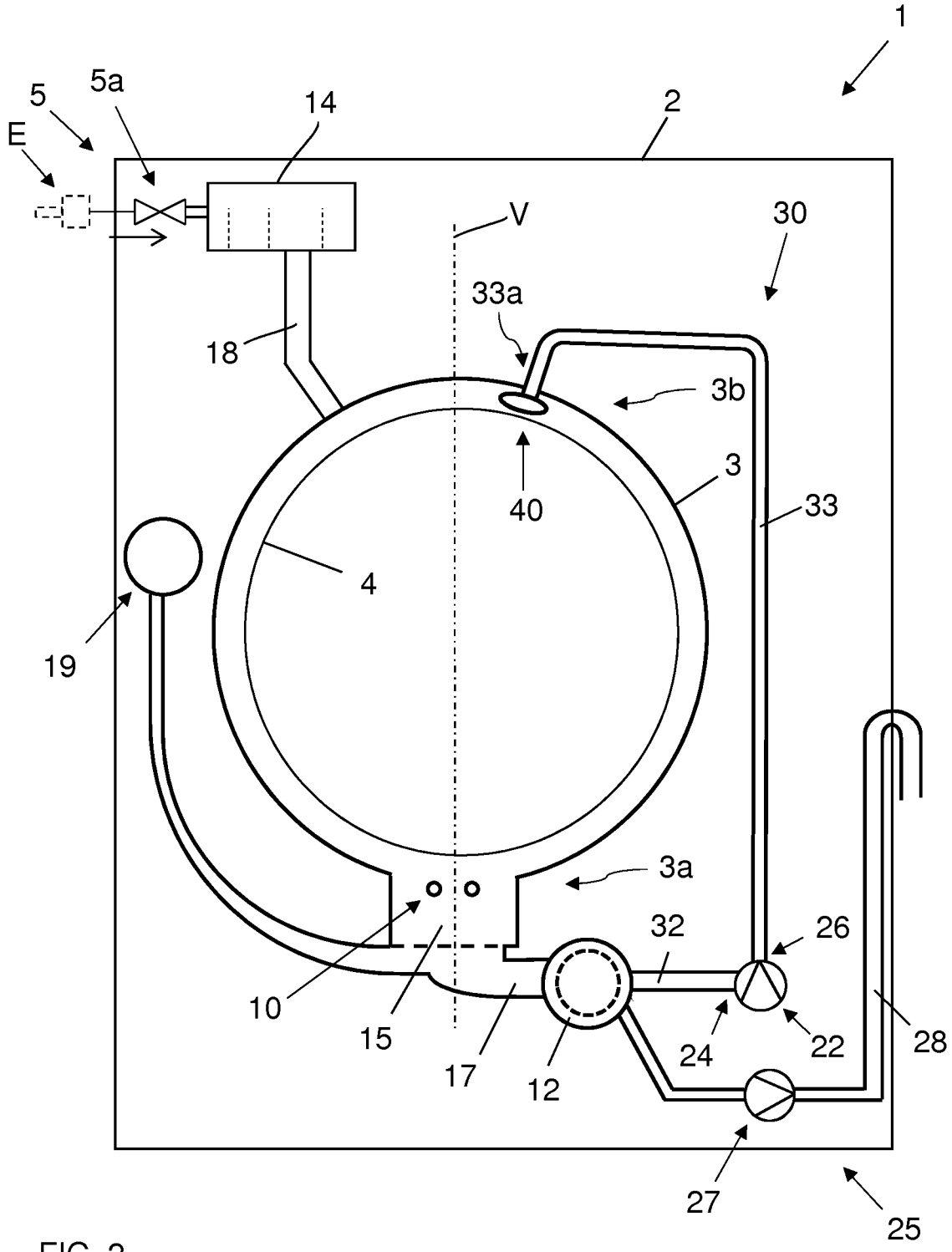
FIG. 2 shows a schematic view of the laundry washing machine of FIG. 1.

With reference to FIGS. 1 and 2, a preferred embodiment of a laundry washing machine 1 according to the invention is described.

The laundry washing machine 1 preferably comprises an external casing or cabinet 2, a washing tub 3, a washing drum 4 received in the washing tub 3, preferably a perforated washing drum 4, where the laundry to be treated can be loaded.

The washing tub 3 and the washing drum 4 both preferably have a substantially cylindrical shape.

The washing tub 3 is preferably connected to the cabinet 2 by means of an elastic bellows 7, or gasket.

The cabinet 2 is provided with a loading/unloading door 8 which allows access to the washing drum 4.

The washing drum 4 is advantageously rotated by an electric motor, not illustrated, which preferably transmits the rotating motion to the shaft 4*a* of the washing drum 4, advantageously by means of a belt/pulley system. In a different embodiment of the invention, the motor can be directly associated with the shaft 4*a* of the washing drum 4.

The washing drum 4 is advantageously provided with holes which allow the liquid flowing therethrough. Said holes are typically and preferably homogeneously distributed on the cylindrical side wall of the washing drum 4.

The bottom region 3*a* of the washing tub 3 preferably comprises a seat 15, or sump, suitable for receiving a heating device 10. The heating device 10, when activated, heats the liquid inside the sump 15.

In different embodiments, nevertheless, the bottom region of the washing tub may be configured differently. For example, the bottom region of the washing tub may not comprise a seat for the heating device. The heating device may be advantageously placed in the annular gap between the washing tub and the washing drum.

Preferably, laundry washing machine 1 comprises a device 19 suited to sense (or detect) the liquid level inside the washing tub 3.

The sensor device 19 preferably comprises a pressure sensor which senses the pressure in the washing tub 3. From the values sensed by the sensor device 19 it is possible to determine the liquid level of the liquid inside the washing tub 3. In another embodiment, not illustrated, laundry washing machine may preferably comprise (in addition to or as a replacement of the pressure sensor) a level sensor (for example mechanical, electro-mechanical, optical, etc.) adapted to sense (or detect) the liquid level inside the washing tub 3.

A water supply circuit 5 is preferably arranged in the upper part of the laundry washing machine 1 and is suited to supply water into the washing tub/drum 3, 4 from an external water supply line E. The water supply circuit 5 preferably comprises a controlled supply valve 5*a* which is properly controlled, opened and closed, during the washing cycle. The water supply circuit of a laundry washing machine is well known in the art, and therefore it will not be described in detail.

The laundry washing machine 1 advantageously comprises a treating agents dispenser 14 to supply one or more treating agents into the washing tub/drum 3, 4 during a washing cycle. Treating agents may comprise, for example, detergents, rinse additives, fabric softeners or fabric conditioners, waterproofing agents, fabric enhancers, rinse sanitization additives, chlorine-based additives, etc.

Preferably, the treating agents dispenser 14 comprises a removable drawer 6 (FIG. 1) provided with various compartments suited to be filled with treating agents.

In a preferred embodiment, not illustrated, the treating agents dispenser may comprise a pump suitable to convey one or more of said agents from the dispenser to the washing tub/drum.

In the preferred embodiment here illustrated, the water is supplied into the washing tub/drum 3, 4 from the water supply circuit 5 by making it flow through the treating agents dispenser 14 and then through a supply pipe 18. The supply pipe 18 hydraulically connects the treating agents dispenser 14 to the washing tub 3.

In an alternative embodiment of the invention, a further separate water supply pipe can be provided, which supplies exclusively clean water into the washing tub/drum from the external water supply line.

In further preferred embodiments, not illustrated herein, a water softening device may preferably be arranged/interposed between the external water supply line and the treating agents dispenser so as to be crossed by the fresh water flowing from the external water supply line. The water softening device, as known, is structured for reducing the hardness degree of the fresh water drawn from the external water supply line E and conveyed to the treating agents dispenser.

In a different embodiment, the water softening device may be arranged/interposed between the external water supply line and the washing tub, so as to be crossed by the fresh water flowing from the external water supply line and conveying it directly to the washing tub/drum.

Laundry washing machine 1 preferably comprises a water outlet circuit 25 suitable for withdrawing liquid from the bottom region 3*a* of the washing tub 3.

The water outlet circuit 25 preferably comprises a main pipe 17, a draining pump 27 and an outlet pipe 28 ending outside the cabinet 2.

The water outlet circuit 25 preferably further comprises a filtering device 12 arranged between the main pipe 17 and the draining pump 27. The filtering device 12 is adapted to retain all the undesirable bodies (for example buttons that have come off the laundry, coins erroneously introduced into the laundry washing machine, etc.). The filtering device 12 can preferably be removed, and then cleaned, through a gate 13 placed advantageously on the front wall of the cabinet 2 of the laundry washing machine 1, as illustrated in FIG. 1.

The main pipe 17 connects the bottom region 3*a* of the washing tub 3 to the filtering device 12.

In a further embodiment, not illustrated, the filtering device 12 may be provided directly in the washing tub 3, preferably obtained in a single piece construction with the latter. In this case, the filtering device 12 is fluidly connected to the outlet of the washing tub 3, in such a way that water and washing liquid drained from the washing tub 3 enters the filtering device 12.

Activation of the draining pump 27 drains the liquid, i.e. dirty water or water mixed with washing and/or rinsing products, from the washing tub 3 to the outside.

The laundry washing machine 1 then preferably comprises a recirculation line 30 which is adapted to drain liquid from the bottom region 3*a* of the washing tub 3 and to re-admit such a liquid into a first region 3*b* of the washing tub/drum 3, 4.

Preferably, the first region 3*b* of the washing tub/drum 3, 4 substantially corresponds to an upper region 3*b* of the washing tub/drum 3, 4. The liquid is preferably re-admitted to the upper region 3*b* of the washing tub/drum 3, 4 in order to soak the laundry inside the washing drum 4. This action is preferably carried out at the beginning of a washing cycle when the laundry needs to be completely soaked. Furthermore, this action is preferably carried out during rinsing phases at the beginning of the washing cycle or during rinsing phases in successive steps of the washing cycle.

Figure 3:
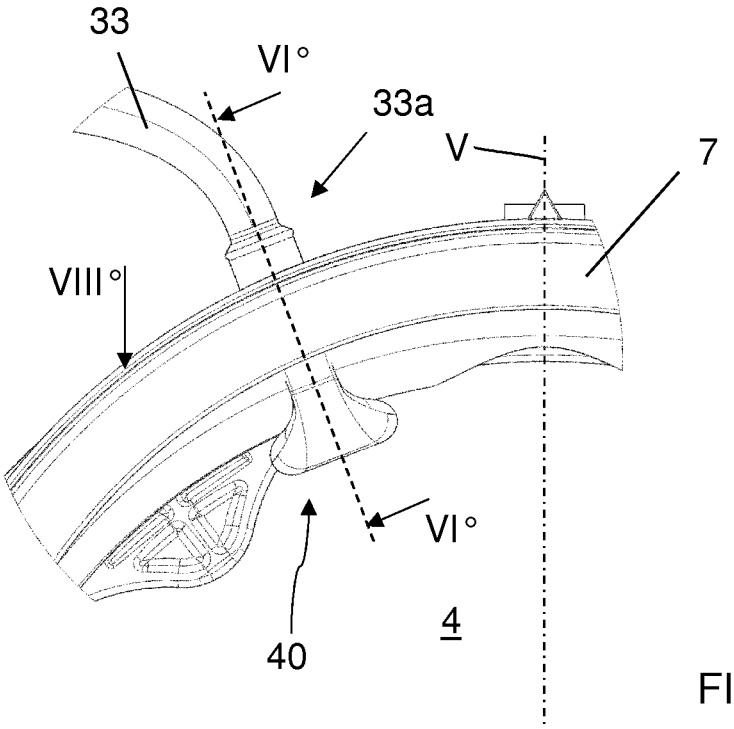
FIG. 3 shows an enlarged view of a detail of FIG. 1 with some components removed therefrom.
Figure 4:
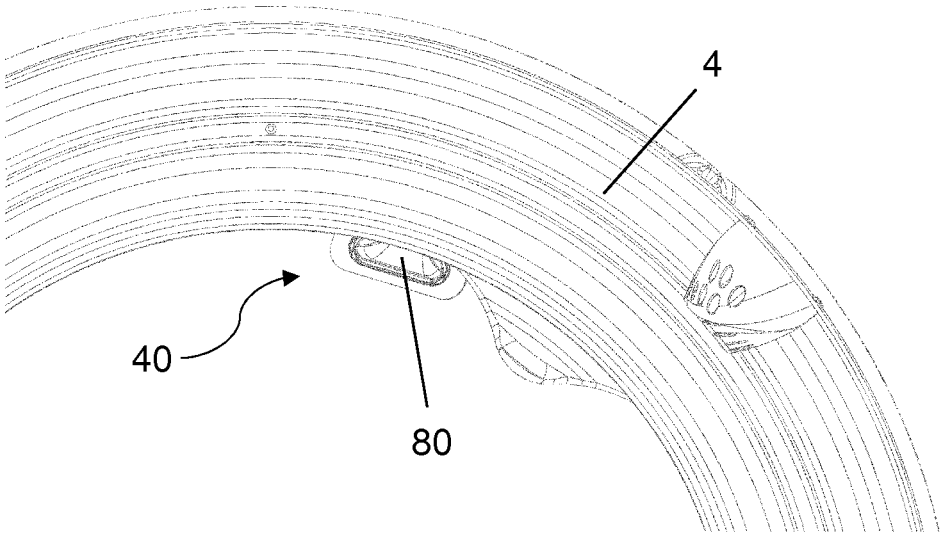
FIG. 4 shows the detail of FIG. 3 from another point of view.

The recirculation line 30 preferably comprises a recirculation duct 33 terminating at said first region 3*b*. Preferably the recirculation duct 33 terminates at the bellows 7, as better illustrated in FIGS. 3 and 6. The recirculation duct 33 is preferably provided with a terminal nozzle 40 having an outlet extremity 80.

The recirculation line 30, then, preferably comprises a recirculation pump 22 comprising an inlet 24 connected to the bottom 3*a* of the washing tub 3 and an outlet 26 for conveying liquid to the recirculation duct 33.

Inlet 24 of the recirculation pump 22 is preferably connected to the bottom 3*a* of the washing tub 3 through a suction pipe 32 preferably connected to the filtering device 12.

In the preferred embodiment here illustrated and described there are two pumps, a draining pump 27 and a recirculation pump 22, as described above.

In a further preferred embodiment, not illustrated, only one pump may be provided and a controlled valve may be arranged downstream of the pump for selectively conveying liquid to a drain duct to the outside or to a recirculation duct to the washing tub.

According to a preferred embodiment of the invention, the recirculation pump 22 is a variable-speed pump, i.e. it can be driven at different speeds.

In a further preferred embodiment of the invention, the recirculation pump may be a fixed speed pump, i.e. it can be driven at one prefixed speed.

In case the recirculation pump 22 is a variable-speed pump, the liquid in the recirculation line 30 may be pumped at different flow rates, as better described later, and thus defining corresponding different working conditions.

In case the recirculation pump 22 is a fixed speed pump, the liquid in the recirculation line 30 is pumped at a corresponding fixed flow rate.

Figure 7:
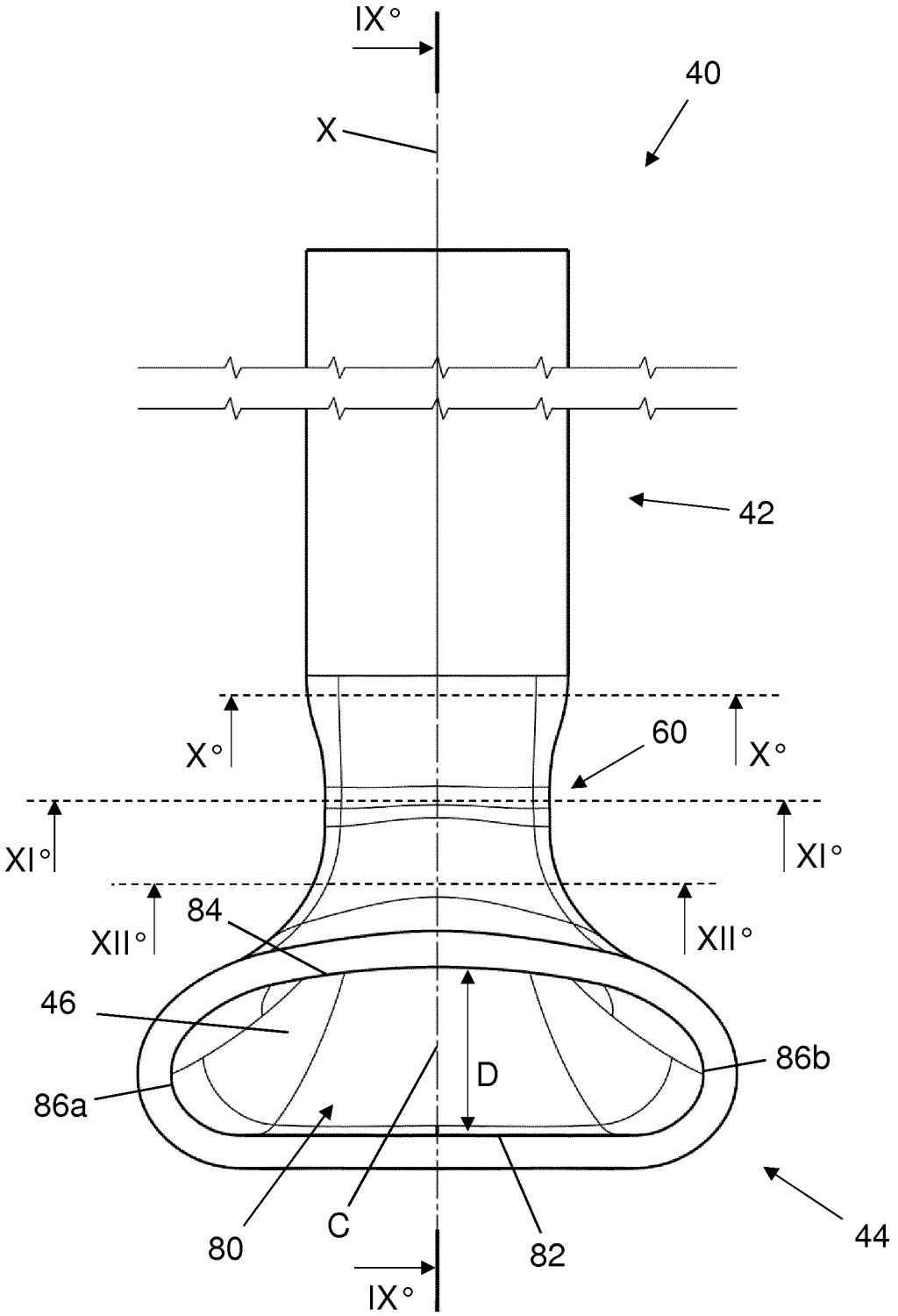
FIG. 7 is a plan frontal view of an element of FIG. 5.
Figure 8:
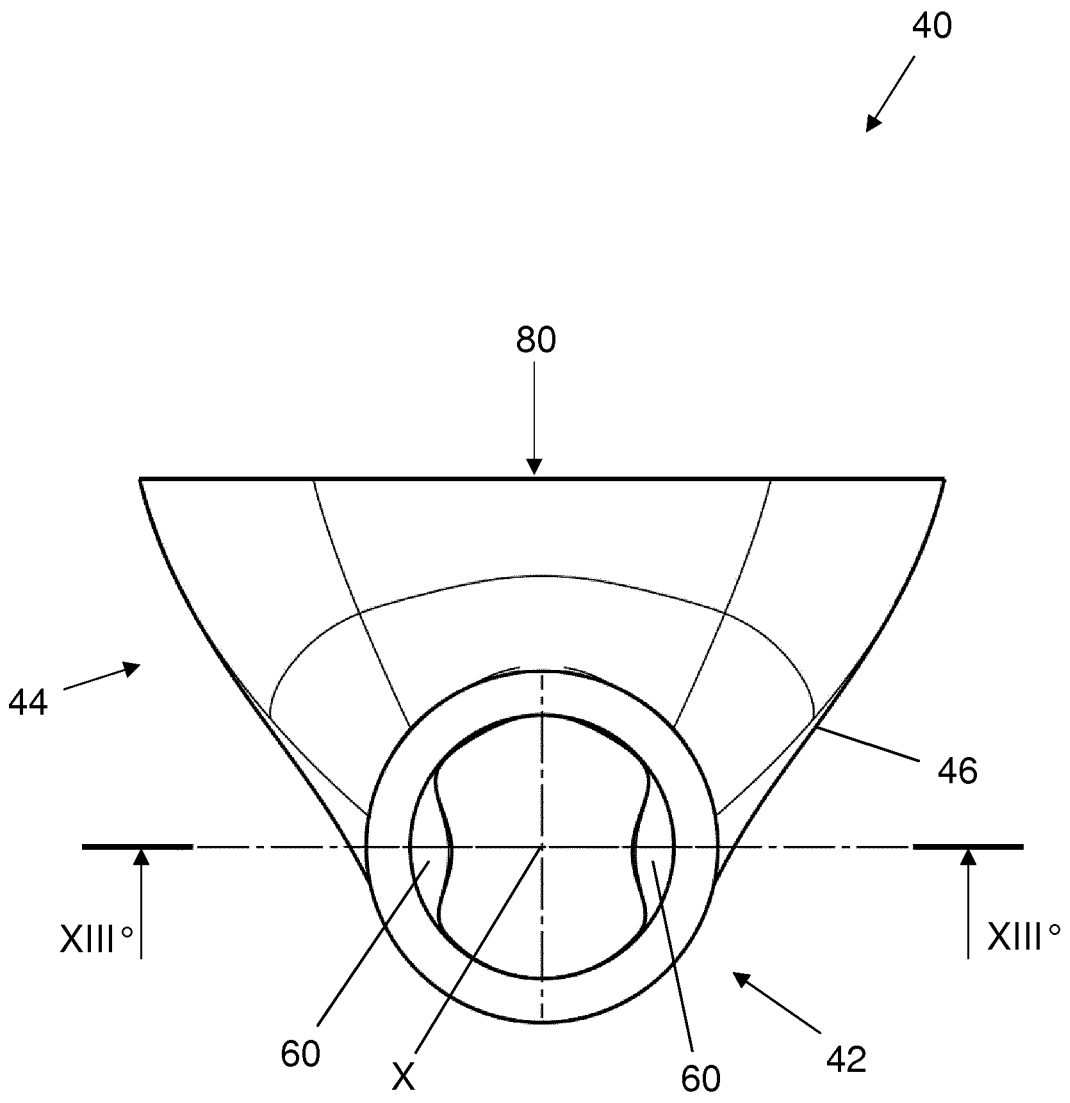
FIG. 8 is a plan upper view of the element of FIG. 7.
Figure 9:
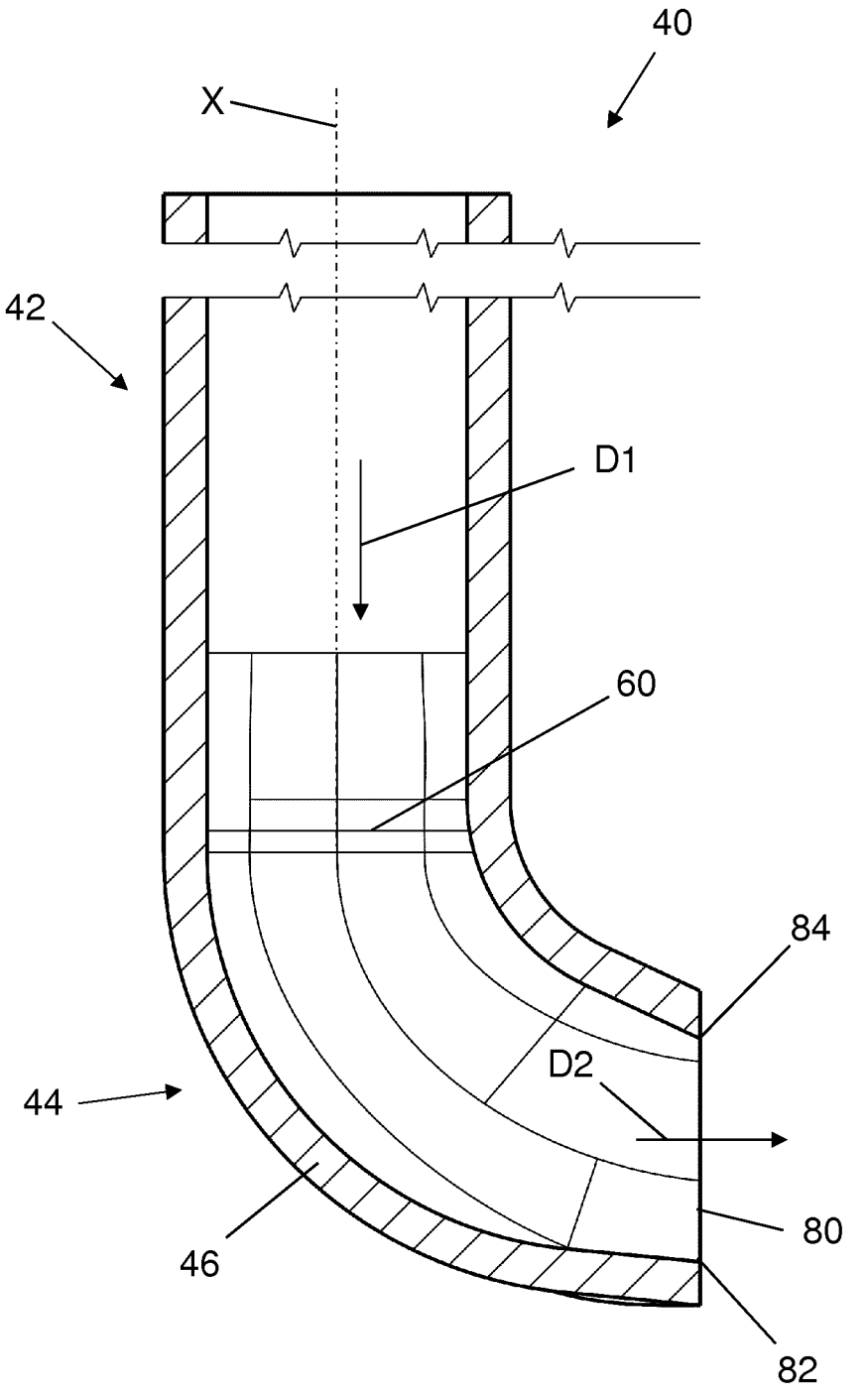
FIG. 9 is a plan sectional view taken along line IX°-IX° of FIG. 7.

According to an aspect of the invention, the nozzle 40 preferably comprises a tubular portion 42 extending along a first axis X and a sprayer portion 44 comprising the outlet extremity 80, as illustrated in FIGS. 7 and 9. The sprayer portion 44 hydraulically communicates with the tubular portion 42. The sprayer portion 44 then preferably comprises a bent zone 46 which is apt to change the direction of a liquid, not shown, flowing through the tubular portion 42 towards the outlet extremity 80.

The tubular portion 42 preferably comprises a portion that extends rectilinearly along the first axis X, for example a cylindrical tubular portion as illustrated herein having a rectilinear axis X.

In different embodiments, nevertheless, the tubular portion may also be curved and therefore extending along a curvilinear axis.

The tubular portion 42, then, preferably comprises a cross section of circular shape, as illustrated herein.

In different embodiments, nevertheless, the cross section of the tubular portion may have different shapes, for example any elliptical shape, any curvilinear closed shape, any polygonal closed shape, or a combination thereof.

Figure 5:
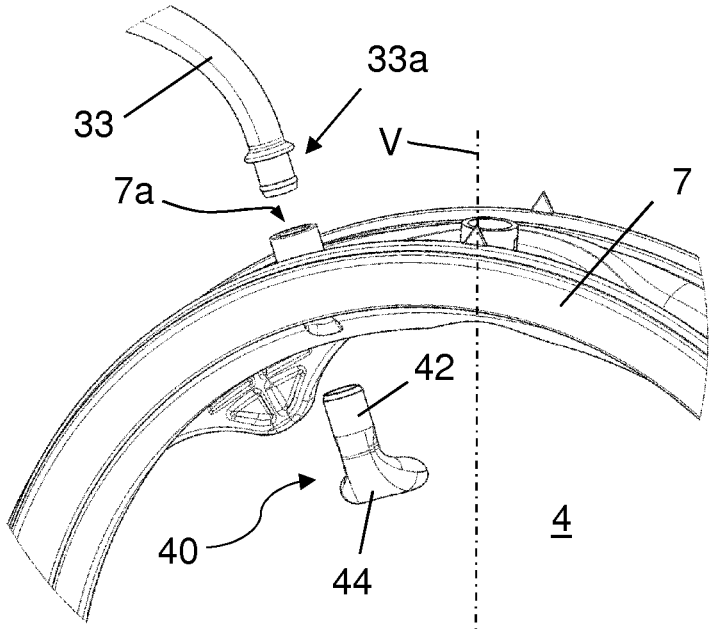
FIG. 5 shows an exploded view of FIG. 3.
Figure 6:
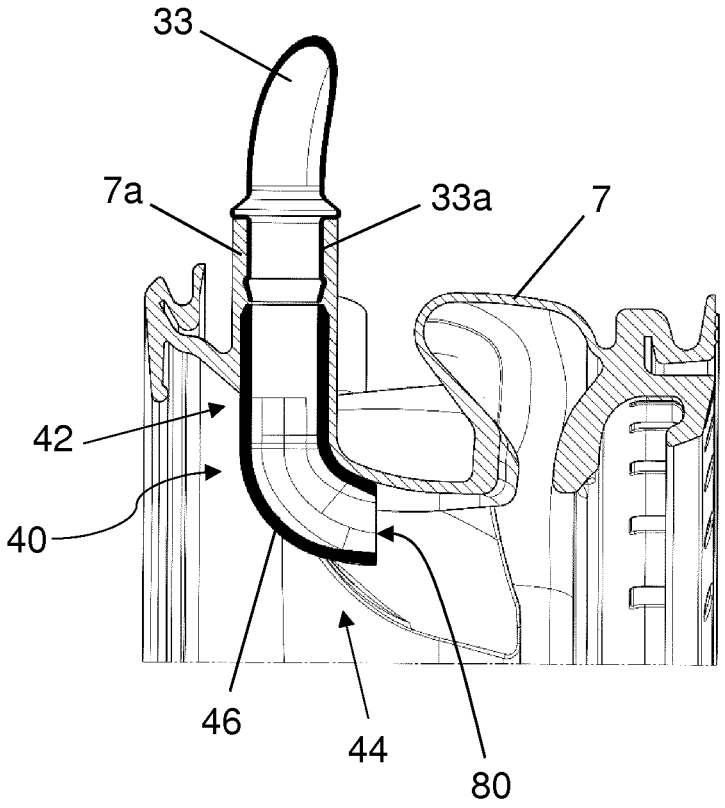
FIG. 6 is a plan sectional view taken along line VI°-VI° of FIG. 3.

The tubular portion 42 is apt to be fluidly connected to an end 33*a* of the recirculation duct 33, as illustrated in particular in FIGS. 5 and 6.

Preferably, the tubular portion 42 and the end 33*a* of the recirculation duct 33 are fluidly connected each other through the bellows 7.

The bellows 7 comprises a housing 7*a* apt to receive from above the end 33*a* of the recirculation duct 33 and to receive from below the nozzle 40.

The housing 7*a* is preferably shaped to completely receive the end 33*a* of the recirculation duct 33, to receive the tubular portion 42 of the nozzle 40 and preferably part of the sprayer portion 44 of the nozzle 40.

The nozzle 40 is therefore preferably in part arranged externally of the same bellows 7 and protrudes therefrom.

According to an aspect of the invention, the nozzle 40 is arranged in a vertical position, or in a vertical substantially position, with respect to the washing tub 3, considering the laundry washing machine 1 installed on a horizontal floor. Preferably, the nozzle 40 is arranged so that the first axis X and the vertical axis V form an angle of 7° therebetween, with the laundry washing machine 1 installed on a horizontal floor.

More preferably the nozzle 40 is arranged at the bellows 7 between the washing tub 3 and the cabinet 2 and opportunely oriented such that the liquid flowing outside the outlet extremity 80 is directed toward the inside of the washing drum 4, as better described in the following.

In different embodiments the position of the nozzle could be different, for example more inclined with respect the vertical axis V and preferably arranged so that the first axis X and the vertical axis V form an angle lower than 30° therebetween, more preferably an angle lower than 10° therebetween.

As illustrated in FIG. 9, the first direction D1 of a liquid flowing in the tubular portion 42 is changed into a different second direction D2 towards the outlet extremity 80 by the bent zone 46.

In the preferred embodiment illustrated herewith, the bent zone 46 is opportunely shaped so that the said two directions D1, D2 are preferably perpendicular, more preferably the first direction D1 is vertical and the second direction D2 is horizontal.

In different embodiments, nevertheless, the bent zone may be opportunely shaped so that the said directions are inclined one to the other with an angle comprised therebetween preferably less than 135°.

According to an advantageous aspect of the invention, the nozzle 40 comprises an obstruction 60 arranged upstream of the bent zone 46 so that the cross-sectional area of the nozzle 40 first decreases and then increases while proceeding from the tubular portion 42 towards the outlet extremity 80.

The cross-sectional area is the area of the nozzle 40, where the liquid may flow, in a plane perpendicular to the first axis X.

It is underlined that in the present application the term "upstream" is referred to the flowing direction of the liquid inside the nozzle 40 during the standard functioning of the laundry washing machine 1 when the recirculation pump 22 is activated; saying that obstruction 60 is arranged upstream of the bent zone 46 means that in the standard functioning of the laundry washing machine 1 when the recirculation pump 22 is activated the liquid firstly circulates inside the obstruction 60 and then passes through the bent zone 46.

The term "downstream", when used, will have the opposite meaning of the term "upstream" as defined above.

Figure 10:
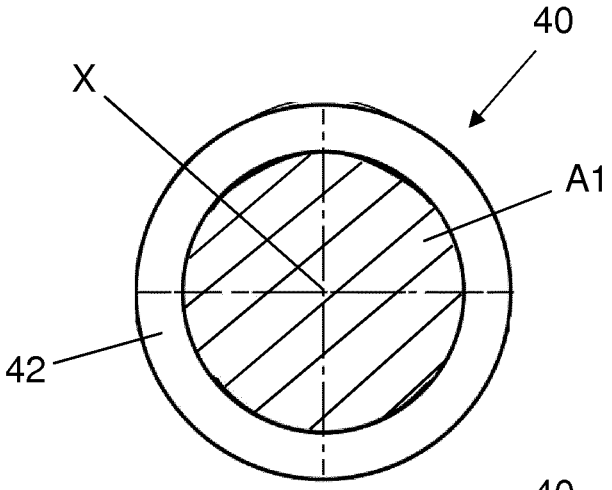
FIG. 10 is a plan sectional view taken along line X°-X° of FIG. 7.
Figure 11:
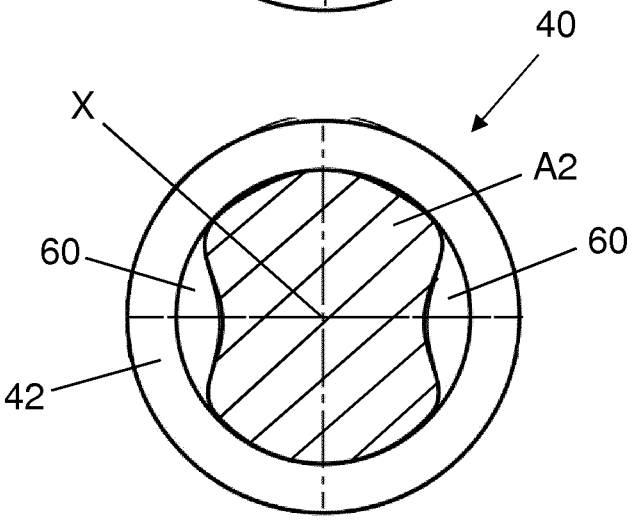
FIG. 11 is a plan sectional view taken along line XI°-XI° of FIG. 7.
Figure 12:
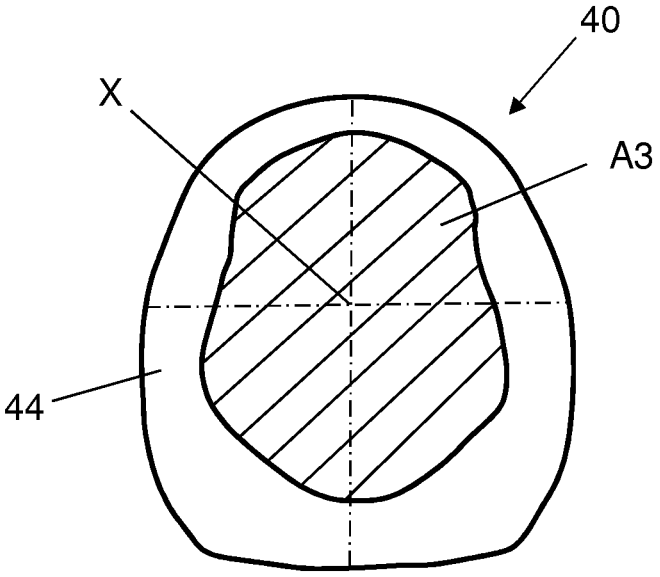
FIG. 12 is a plan sectional view taken along line XII°-XII° of FIG. 7.
Figure 13:
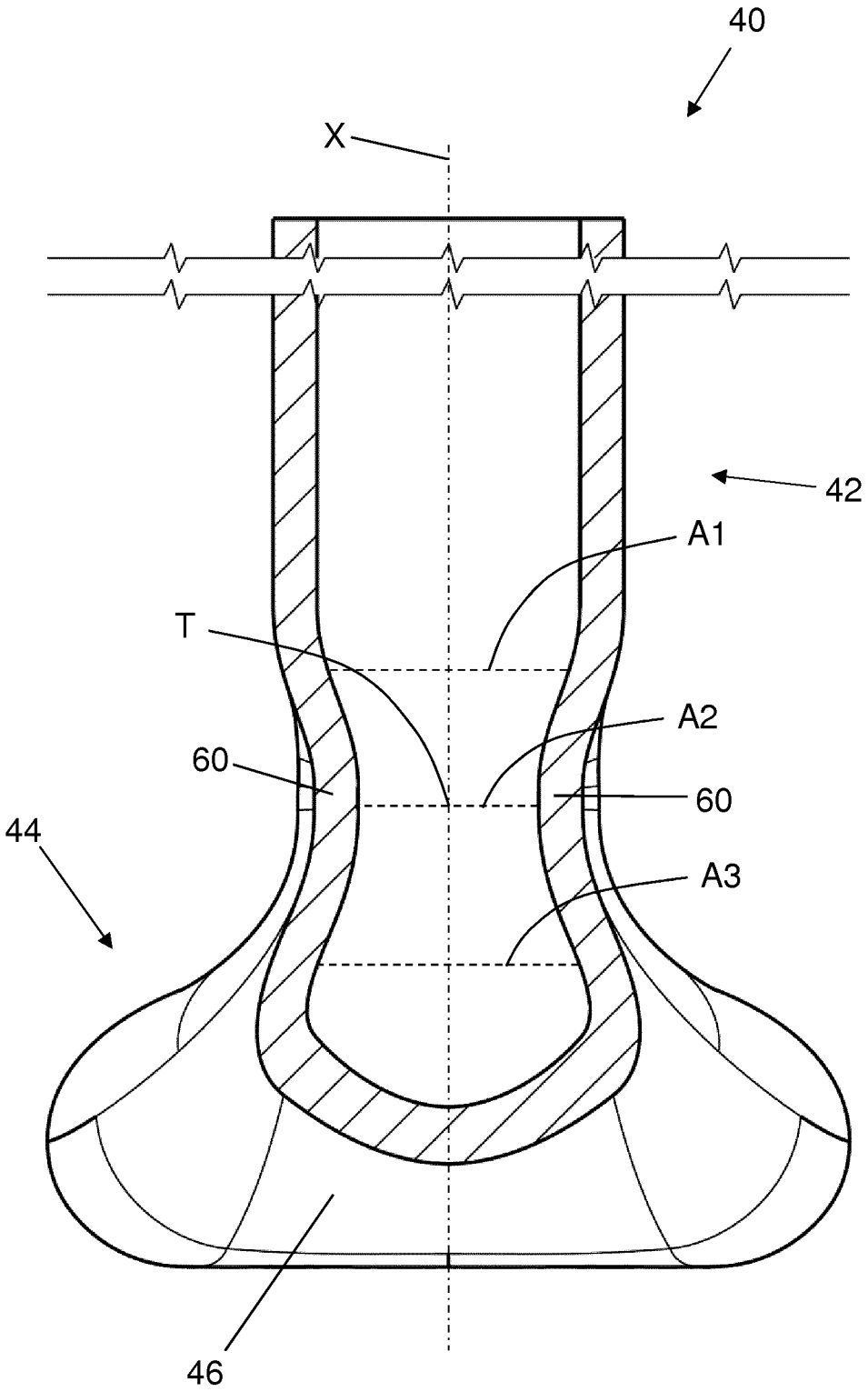
FIG. 13 is a plan sectional view taken along line XIII°-XIII° of FIG. 8.

This advantageous feature may be appreciated in particular in FIG. 13 or by comparing FIGS. 10 to 12. The obstruction 60 causes the cross-sectional area of the nozzle 40 first to decrease, i.e. from the first area A1 depicted in FIG. 10 to a second smaller area A2 depicted in FIG. 11, and then to increases, i.e. from the second smaller area A2 depicted in FIG. 11 to a third larger area A3 depicted in FIG. 12. Preferably, the obstruction 60 is arranged in the border zone between the tubular portion 42 and the sprayer portion 44.

Preferably, the cross-sectional area of the nozzle 40 monotonically decreases from the first area A1 to the second smaller area A2 and/or preferably monotonically increases from the second smaller area A2 to the third larger area A3.

Preferably, the second smaller area A2 is defined at a single point, or at a substantially single point, along the first axis X of the tubular portion 42 (point T depicted in FIG. 13).

Preferably, the cross-sectional area A2 at the obstruction 60 is comprised between 50% and 90% of the cross-sectional area A1 at the tubular portion 42, more preferably equal to 70%.

The sprayer portion 44 preferably has a width that expands towards the outlet extremity 80 and more preferably shows a trapezoidal shape.

The outlet extremity 80 preferably comprises a lower edge 82 and an upper edge 84 connected therebetween (see FIG. 7).

The lower edge 82 is preferably rectilinear. The upper edge 84 is preferably arcuate. The lower edge 82 and the upper edge 84 are preferably connected at opposite ends 86*a*, 86*b* by rounded corners.

Preferably, the distance D between the upper edge 84 and the lower edge 82 decreases by proceeding from the center C of the outlet extremity 80 towards the opposite ends 86*a*, 86*b*, as shown in FIG. 7.

Advantageously, as better described below, the liquid L leaving the outlet extremity 80 does not touch the central part, or most of the central part, of the upper edge 84 of the outlet extremity 80 (as better visible, for example, in Figures from 14A to 14C).

Advantageously, turbulences of the liquid leaving the outlet extremity 80 are reduced compared to known nozzles.

More advantageously, turbulences of the liquid leaving the outlet extremity 80 are reduced compared to known nozzles in any working condition.

These advantageous aspects are achieved by the presence of the obstruction 60.

The obstruction 60 with its cross-sectional area A2, in fact, causes the liquid to distribute over the bent zone 46 of the sprayer portion 44 up to outlet extremity 80.

The liquid reaching the outlet extremity 80 preferably does not fill completely the corresponding cross-sectional area in any working condition.

Functioning of the laundry washing machine 1 in different working conditions is explained with some examples as shown in FIGS. 14A, 14B, 14C and 15.

Figure 14A:
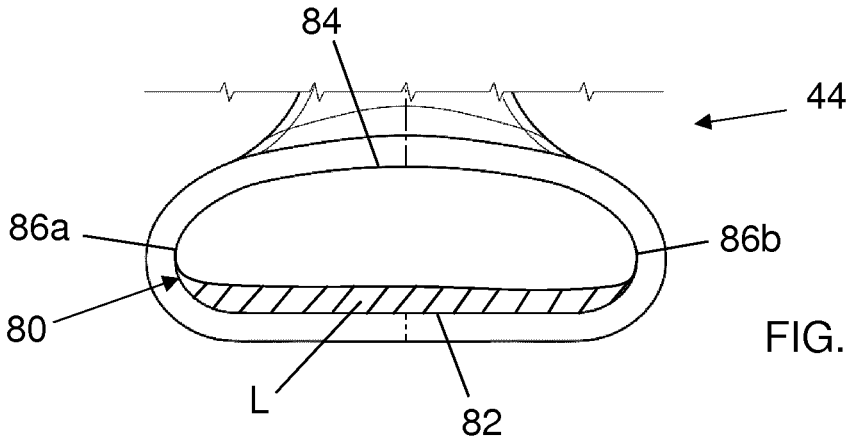
FIGS. 14A, 14B and 14C show a detail of FIG. 7 in different working conditions.

FIG. 14A refers to a first working condition wherein the recirculation pump 22 is preferably driven at a low speed and the liquid in the recirculation line 30 is pumped at a corresponding low flow rate. At the outlet extremity 80 the liquid L shows a first course and leaves the same outlet extremity 80 so that it can be sprayed onto the laundry at the near side in front of the washing drum 4 (as indicated with line Lf in FIG. 15).

Advantageously, the liquid L leaving the outlet extremity 80 does not touch the upper edge 84. Creation of turbulences is therefore avoided.

Figure 14B:
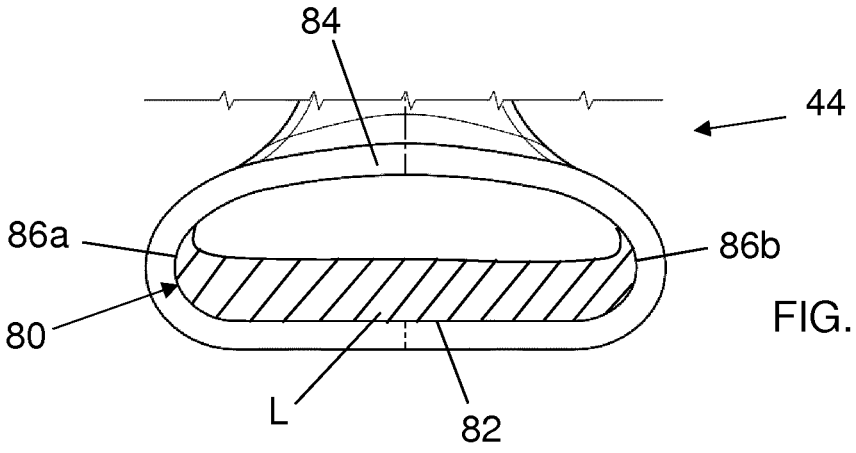

FIG. 14B refers to a second working condition wherein the recirculation pump 22 is preferably driven at a medium speed and the liquid in the recirculation line 30 is pumped at corresponding medium flow rate. At the outlet extremity 80 the liquid L shows a second course and leaves the same outlet extremity 80 so that it can be sprayed onto the laundry at the centre of the washing drum 4 (as indicated with line Mf in FIG. 15).

Advantageously, again, the liquid L leaving the outlet extremity 80 does not touch the central part of the upper edge 84. Creation of turbulences is therefore avoided.

Figure 14C:
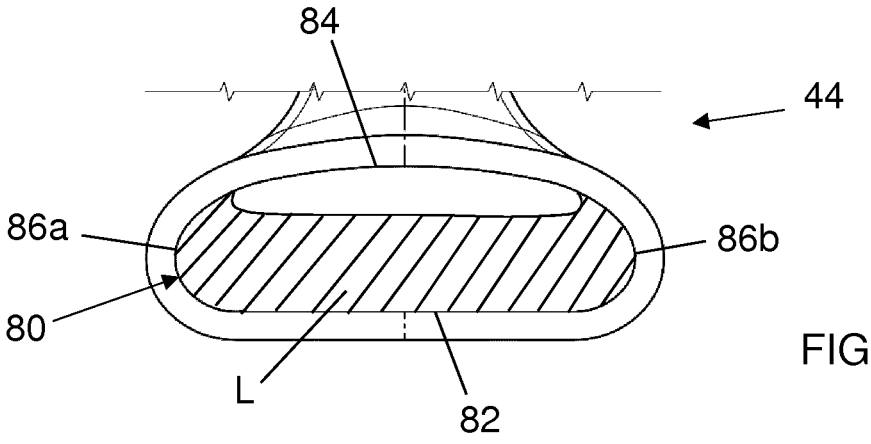
Figure 15:
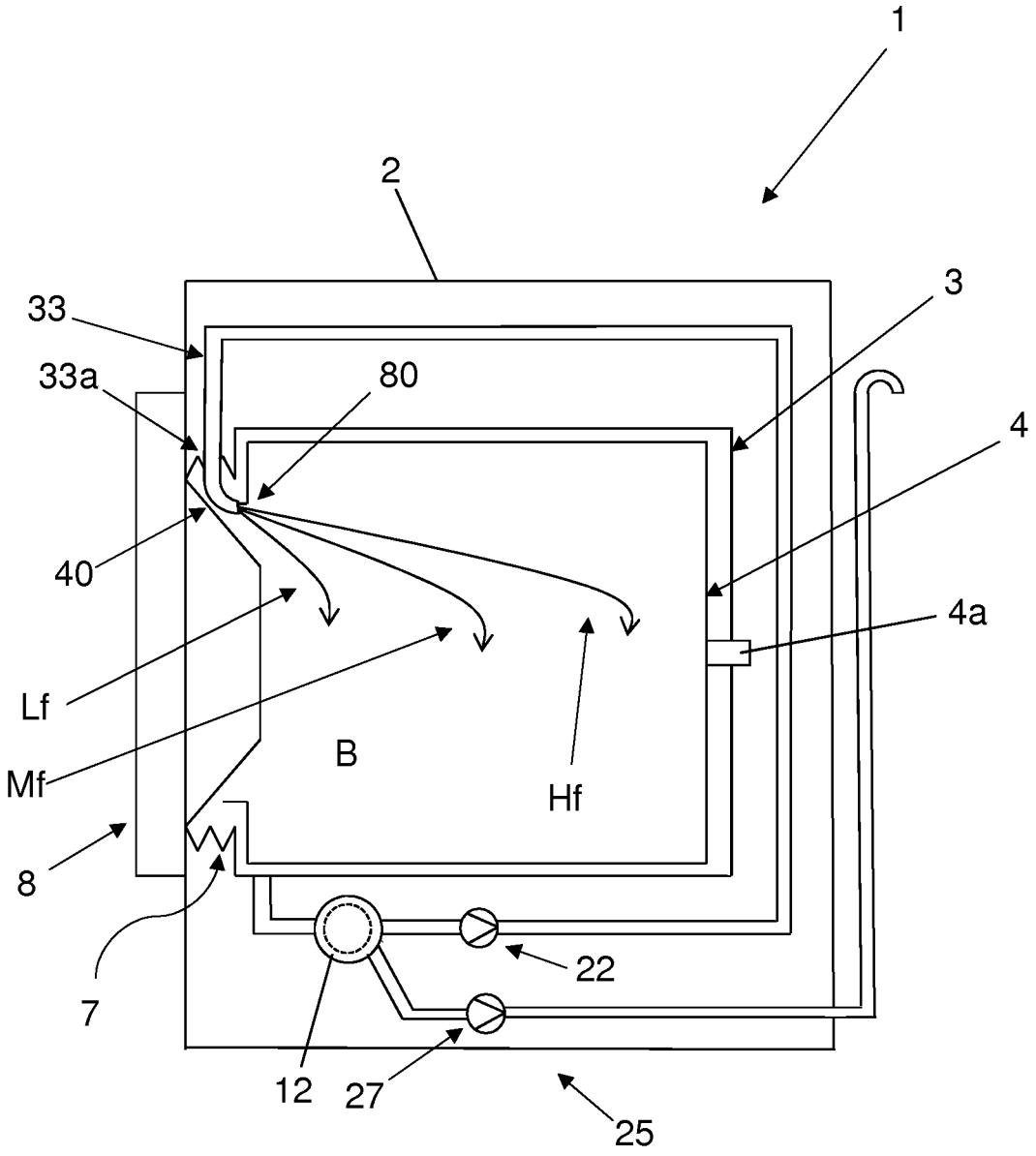
FIG. 15 shows a side schematic view of the laundry washing machine of FIG. 1.

FIG. 14C refers to a third working condition wherein the recirculation pump 22 is preferably driven at a high speed and the liquid in the recirculation line 30 is pumped at corresponding high flow rate. At the outlet extremity 80 the liquid L shows a third course and leaves the same outlet extremity 80 so that it can be sprayed onto the laundry at the far side of the washing drum 4 (as indicated with line Hf in FIG. 15).

Advantageously, again, the liquid L leaving the outlet extremity 80 does not touch the central part of the upper edge 84. Creation of turbulences is therefore avoided.

From the above, it follows that the proposed solution advantageously enables the control of the flow direction of the liquid over the laundry as a function of the flow rate assuring the optimal liquid distribution over the laundry in each working condition.

In case the recirculation pump 22 is a fixed speed pump, then, it is in any case assured that creation of turbulences is avoided or strongly limited when the liquid L leaves the outlet extremity 80, irrespective of the working speed set for the recirculation pump.

For example, manufacturers can take advantage of this aspect by producing a unique type nozzle that can be mounted on different types of laundry washing machines using recirculation pumps working at different fixed speed. Manufacturing costs are thus reduced. Irrespective of the recirculation pump mounted on the laundry washing machine, therefore, the nozzle assures that creation of turbulences is avoided or strongly limited.

It is clear that in case the recirculation pump 22 is a fixed speed pump the liquid L is sprayed onto the laundry at a substantially fixed position inside the washing drum 4.

Preferably, the tubular portion 42 is integrally made with the sprayer portion 44.

In further preferred embodiments of the invention, the nozzle may be realized with different parts structured for being reciprocally coupled.

In a preferred embodiment, the nozzle or parts realizing the same are made of a rigid material, preferably a rigid plastic material, more preferably made of POM (Polyoxymethyleneplast).

Figure 16A:
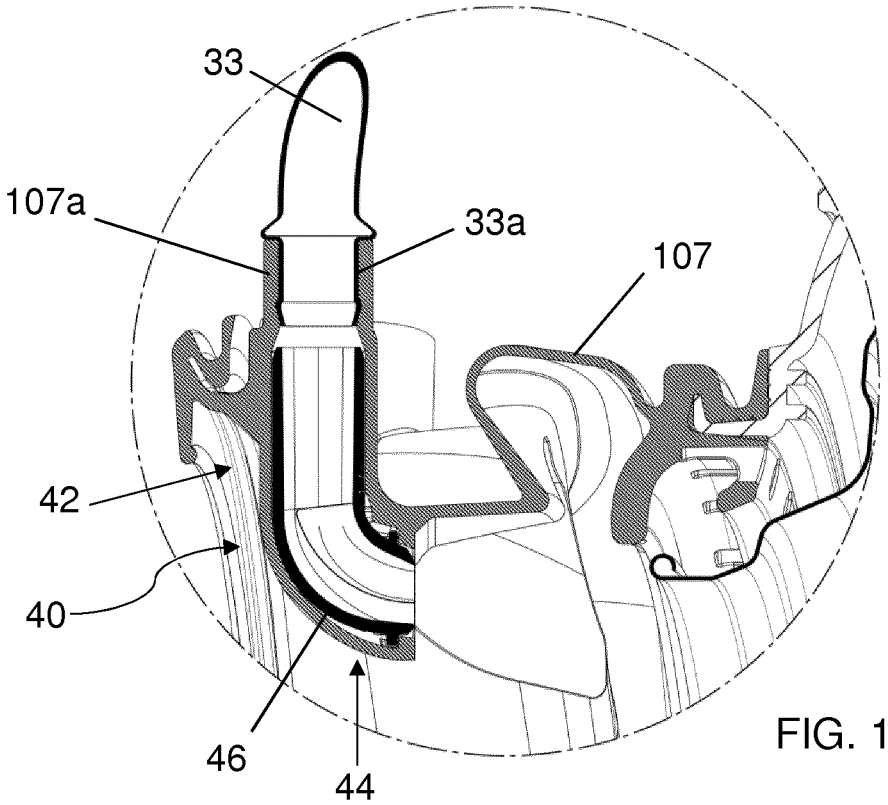
FIG. 16A shows a further embodiment of FIG. 6.
Figure 16B:
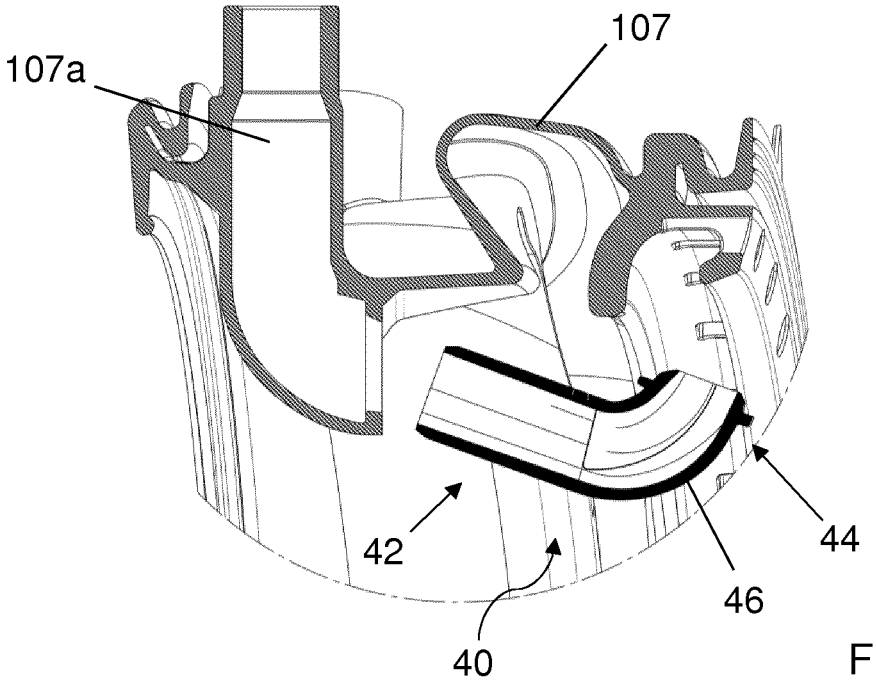
FIG. 16B shows the elements of FIG. 16A before assembling.

With reference to FIGS. 16A and 16B a further preferred embodiment of the invention is described which differs from the preferred embodiment previously described in that the bellows 107 comprises a housing 107*a* apt to completely receive the nozzle 40 therein.

The housing 107*a* is preferably shaped to totally match the outer surface of the nozzle 40.

When the nozzle 40 is received in the housing 107*a* of the bellows it does not protrude therefrom.

FIG. 16B shows the nozzle 40 before it is assembled in the housing 107*a* of the bellows 107.

It has thus been shown that the present invention allows all the set objects to be achieved. In particular, it makes it possible to provide a laundry washing machine having a liquid supply system which guarantees an optimal liquid distribution over the laundry, also at different flow rate conditions, compared to known systems.

The recirculation line 30 above described is an example of a liquid supply line in a laundry washing machine which advantageously implements the invention.

In different preferred embodiment, a liquid supply line may be any other supply line which supplies liquid into the washing tub/drum and provided with a nozzle at its extremity. For example, looking at FIG. 2, the supply pipe 18 connecting the treating agents dispenser 14 to the washing tub 3 provided at its end with a nozzle can be considered a liquid supply line according to the invention.

While the present invention has been described with reference to the particular embodiments shown in the figures, it should be noted that the present invention is not limited to the specific embodiments illustrated and described herein; on the contrary, further variants of the embodiments described herein fall within the scope of the present invention, which is defined in the claims.

The invention claimed is:

1. A laundry washing machine comprising:

a cabinet;

a tub and drum assembly supported inside the cabinet and comprising a washing tub and a washing drum located inside the washing tub and configured to receive laundry;

a liquid supply line configured to supply liquid into the tub and drum assembly through an outlet extremity, the liquid supply line comprising, at an end thereof, a nozzle comprising the outlet extremity, the nozzle comprising a tubular portion extending along an axis and a sprayer portion comprising the outlet extremity and hydraulically communicating with the tubular portion, wherein the sprayer portion comprises a bent zone which is configured to change a direction of a liquid flowing through the tubular portion towards the outlet extremity, wherein the nozzle comprises an obstruction arranged upstream of the bent zone so a cross-sectional area of the nozzle first decreases and then increases while proceeding from the tubular portion towards the outlet extremity, wherein at the decrease arranged upstream of the bent zone, opposite side walls of the tubular portion are converged in a direction traverse to a long axis of the tubular portion.

2. The laundry washing machine according to claim 1, wherein the cross-sectional area first monotonically decreases and/or then monotonically increases while proceeding from the tubular portion towards the outlet extremity.

3. The laundry washing machine according to claim 1, wherein the cross-sectional area comprises a smaller area wherein the smaller area is defined at a single point along the axis.

4. The laundry washing machine according to claim 1, wherein the tubular portion comprises a portion that extends rectilinearly along the axis.

5. The laundry washing machine according to claim 1, wherein, with the laundry washing machine installed on a horizontal floor, the nozzle is arranged so that the axis of the tubular portion and a vertical axis form an angle lower than 30° therebetween.

6. The laundry washing machine according to claim 1, wherein the bent zone is configured to change a first direction of a liquid flowing in the tubular portion into a second direction of the liquid towards the outlet extremity.

7. The laundry washing machine according to claim 6, wherein the first direction and the second direction are inclined one to the other with an angle comprised therebetween of less than 135°.

8. The laundry washing machine according to claim 6, wherein the first direction and the second direction are inclined one to the other with an angle comprised therebetween of less than or equal to 90°.

9. The laundry washing machine according to claim 1, wherein the outlet extremity comprises a lower edge and an upper edge connected therebetween at opposite ends.

10. The laundry washing machine according to claim 9, wherein a distance between the upper edge and the lower edge decreases by proceeding from a center of the outlet extremity towards the opposite ends, the distance being measured in a direction parallel to the axis.

11. The laundry washing machine according to claim 9, wherein the lower edge is rectilinear and the upper edge is arcuate.

12. The laundry washing machine according to claim 9, wherein the lower edge is rectilinear or the upper edge is arcuate.

13. The laundry washing machine according to claim 1, wherein the liquid supply line comprises a recirculation system configured to drain a quantity of the liquid from a bottom of the washing tub and to re-admit the quantity of the liquid into a first region of the tub and drum assembly, the recirculation system comprising a recirculation pump and a recirculation duct connected to the nozzle.

14. The laundry washing machine according to claim 13, wherein the recirculation pump is a variable-speed pump.

15. The laundry washing machine according to claim 1, wherein the liquid supply line is configured to supply liquid into the tub and drum assembly at different flow rates.

16. The laundry washing machine according to claim 1, wherein the nozzle is arranged at a bellows interposed between the cabinet and the washing tub.

17. The laundry washing machine according to claim 16, wherein the bellows comprises a housing configured to receive the nozzle.

18. The laundry washing machine according to claim 1, wherein, with the laundry washing machine installed on a horizontal floor, the nozzle is arranged so that the axis of the tubular portion and a vertical axis form an angle lower than 10° therebetween.

19. The laundry washing machine according to claim 1, wherein, with the laundry washing machine installed on a horizontal floor, the nozzle is arranged so that the axis of the tubular portion and a vertical axis form an angle equal to 7° therebetween.

* * * * *